US009989239B2

(12) United States Patent
Johnson

(10) Patent No.: US 9,989,239 B2
(45) **Date of Patent: *Jun. 5, 2018**

(54) LED LAMPS AND LUMINAIRES

(71) Applicant: Gooee Limited, St Albans (GB)

(72) Inventor: Andrew Johnson, Klosters (CH)

(73) Assignee: Gooee Limited, St Albans (GB)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/678,958

(22) Filed: Aug. 16, 2017

(65) Prior Publication Data

US 2017/0350583 A1 Dec. 7, 2017

Related U.S. Application Data

(63) Continuation of application No. 15/306,733, filed as application No. PCT/IB2015/053034 on Apr. 26, 2015, now Pat. No. 9,777,915.

(30) Foreign Application Priority Data

Apr. 25, 2014 (GB) ..... 1407301.9

(51) Int. Cl.
*F21V 29/77* (2015.01)
*F21V 23/00* (2015.01)
(Continued)

(52) U.S. Cl.
CPC ..... *F21V 29/77* (2015.01); *F21K 9/233* (2016.08); *F21S 8/026* (2013.01); *F21V 3/0418* (2013.01);
(Continued)

(58) Field of Classification Search
CPC ..... F21V 29/77; F21V 29/507; F21V 29/89; F21V 3/0418; F21V 5/04; F21V 21/26;
(Continued)

(56) References Cited

U.S. PATENT DOCUMENTS 8,696,170 B2 4/2014 Huang
8,860,310 B2 10/2014 Huang et al.
(Continued)

FOREIGN PATENT DOCUMENTS

EP 2505914 A2 10/2012
WO WO-2013020773 A2 2/2013
(Continued)

OTHER PUBLICATIONS

GB Search Report of GB Patent Application No. GB1507077.4, dated May 6, 2015, 1 pg, which is in the same family as U.S. Appl. No. 15/306,733.
(Continued)

*Primary Examiner* — Laura Tso
(74) *Attorney, Agent, or Firm* — Moyles IP, LLC

(57) ABSTRACT

An LED downlight lighting module is provided including an LED module having one or more single LEDs on a first printed circuit board, a heat sink, and a second printed circuit board. In an embodiment, the first printed circuit board is in good thermal contact with the heat sink such that heat from the LEDs is dissipated through the heat sink. In an embodiment, the second printed circuit board is adapted to accommodate a power and control circuitry for the LEDs, and is thermally insulated from the heat sink and from the first printed circuit board, and thus from the LED module. According to an aspect, the LEDs serve as the principal heat generating component on the printed circuit board, thus helping to increase the light output from the LEDs and/or increase the lifespan of the LED downlight lighting module.

18 Claims, 6 Drawing Sheets

(51) Int. Cl.

| | |
|---|---|
| ***F21V 25/12*** | (2006.01) |
| ***F21S 8/02*** | (2006.01) |
| ***F21V 3/04*** | (2018.01) |
| ***F21V 29/89*** | (2015.01) |
| ***F21V 29/507*** | (2015.01) |
| ***F21V 5/04*** | (2006.01) |
| ***F21K 9/233*** | (2016.01) |
| ***F21V 21/26*** | (2006.01) |
| *H05B 37/02* | (2006.01) |
| *H05B 33/08* | (2006.01) |
| *F21V 29/83* | (2015.01) |
| *F21V 29/71* | (2015.01) |
| *F21V 19/00* | (2006.01) |
| *F21Y 115/10* | (2016.01) |

(52) U.S. Cl.

CPC ..... *F21V 5/04* (2013.01); *F21V 21/26* (2013.01); *F21V 23/005* (2013.01); *F21V 23/006* (2013.01); *F21V 23/009* (2013.01); *F21V 25/12* (2013.01); *F21V 29/507* (2015.01); *F21V 29/89* (2015.01); *F21V 19/003* (2013.01); *F21V 29/713* (2015.01); *F21V 29/773* (2015.01); *F21V 29/83* (2015.01); *F21Y 2115/10* (2016.08); *H05B 33/0845* (2013.01); *H05B 37/0272* (2013.01)

(58) Field of Classification Search

CPC .... F21V 23/005; F21V 23/006; F21V 23/009; F21V 25/12; F21V 29/773; F21V 29/83; F21V 19/003; F21K 9/233; F21S 8/026; F21Y 2115/10; H05B 33/0845; H05B 37/0272

USPC ..... 362/235

See application file for complete search history.

(56) References Cited

U.S. PATENT DOCUMENTS

| | | | | |
|---|---|---|---|---|
| 9,332,621 | B2 | 5/2016 | Sagal et al. | |
| 9,353,914 | B2 | 5/2016 | Jang et al. | |
| 2011/0234078 | A1* | 9/2011 | Choi | F21K 9/00 313/46 |
| 2012/0057327 | A1* | 3/2012 | Le | F21V 3/02 362/84 |
| 2012/0069545 | A1* | 3/2012 | Choi | F21V 3/00 362/84 |
| 2012/0195053 | A1 | 8/2012 | Wu | |
| 2013/0235586 | A1 | 9/2013 | Gielen et al. | |
| 2014/0247606 | A1* | 9/2014 | Chen | F21V 29/004 362/363 |

FOREIGN PATENT DOCUMENTS

| | | |
|---|---|---|
| WO | WO-2013060510 A1 | 5/2013 |
| WO | WO-2014027327 A1 | 2/2014 |

OTHER PUBLICATIONS

International Search Report of International Application No. PCT/IB2015/053034, dated Aug. 4, 2016, 3 pages, which is in the same family as U.S. Appl. No. 15/306,733.

International Search Report & Written Opinion of ISA dated Aug. 4, 2015 in App. No. PCT/IB2015/053034 corresponding to U.S. Appl. No. 15/306,733; 12 pages.

* cited by examiner

LED LAMPS AND LUMINAIRES

CROSS-REFERENCE TO RELATED APPLICATIONS

The application is a continuation of U.S. patent application Ser. No. 15/306,733 filed Oct. 25, 2016, which claims priority to PCT Application No. PCT/IB2015/053034 filed Apr. 26, 2015, which claims priority to GB Patent Application No. 1407301.9 filed Apr. 25, 2014, which was filed as GB Patent Application No. 1507077.4 on Apr. 27, 2015, and published as U.S. Pat. No. 2,525,508 B2 on Oct. 19, 2016, all of which are incorporated herein by reference in their entireties.

FIELD

LED light engines, LED lamps and LED luminaires are generally described. More particularly, LED lighting modules, LED lamps and LED products containing an on board driver and/or on board control integrated circuits, are generally described.

BACKGROUND

LED luminaires and lamps are increasing in popularity and it is expected that this popularity will continue to increase in the future as their light output improves both quantitatively and qualitatively. With lighting units that include LED modules it is important to prevent overheating of the LED module, because overheating can seriously reduce the service life of the lighting element, resulting in premature failure of the LED lamp/luminaire.

In many currently available LED lamps and luminaires one or more LED modules together with their associated driver(s) and other control components are mounted together on the same printed circuit board, generally a metal printed circuit board (MCPCB), often made of aluminum, and this is in close thermal contact with a heat sink. This arrangement allows for the rapid transfer of heat away from the LED module(s).

As LED's enter mainstream lighting applications, consumers expect their operation to mimic traditional lighting units such as incandescent bulbs and fluorescent tubes. This includes being able to dim LEDs and being able to control LEDs remotely from hand held devices such as smart phones and tablets by way of appropriately designed Applications ("Apps"). Furthermore, a new generation of 'smart' light fitting luminaires is starting to become available that contain detectors that sense information about their local environment and which communicate this information to a processor. These light fitting luminaires are a way of collecting data about the environment in which they are situated. This overcomes the problems associated with dedicated sensors in a particular location, such as a room thermostat which only covers a limited area, because a building or house will contain many light fitting luminaires, each capable of gathering data. The data gathered by these luminaires thus has a much higher granularity than data collected by other approaches, and is therefore more useful.

These various advances inevitably require additional processing power, often by way of control integrated circuits (ICs) with increased functionality, including data storage capacity and wireless communication functionally. These can all produce significant amounts of heat, in addition to the heat produced by the LED, leading to a requirement for larger heat sinks in order to keep the temperature of the LED MCPCB down to acceptable levels.

There is a need for a system to overcome or mitigate some or all of the problems outlined above.

SUMMARY

According to an aspect, an LED lighting module is provided. The LED lighting module may include: (i) an LED module comprising one or more single LEDs on a first printed circuit board (PCB); (ii) a heat sink, the first printed circuit board (PCB) being in good thermal contact with the heat sink such that heat from the LED(s) is dissipated through the heat sink; and (iii) a second printed circuit board adapted to accommodate the power and control circuitry for the LED(s), wherein the second printed circuit board is thermally insulated from both the heat sink and from the first printed circuit board and thus from the LED module. According to an aspect, the second printed circuit board may be located within a driver box accommodated within a void or recess in the heat sink structure. The driver box may be thermally insulated from the heat sink and the first printed circuit board, thus providing thermal insulation to the second printed circuit board.

By having the LED as the principal heat generating component on the LED PCB, and by separating the LED PCB, and thus the heat generated by the LED in use, from the control circuitry and components required to power and control the LED and the heat that they produce, and by mounting those non-LED components on one or more separate PCBs, it is possible to increase the light output from the LED and/or increase the lifespan of the LED lighting module. This is particularly the case when the LED lighting module is used in an application where there is reduced air circulation, such as in enclosed or fire rated luminaires. For example, the LED lighting modules disclosed herein may help to achieve a life of 25,000 hours or more at L70 (70% lumen maintenance). This assumes that there is some free air space around the bulb/luminaire. It will be appreciated that if there is restricted air flow around the LED lighting module, such as when it or the luminaire it is in is covered by insulation material, then this life expectancy will be reduced somewhat.

The thermal insulation between the first PCB and the second PCB can take a variety of forms. It could, for example, take the form of a sheet or layer of insulation material, a potting compound if the second PCB is in an enclosed space, or in the form of an air gap between the first and second PCBs with or without additional insulating materials.

According to an aspect, the second printed circuit board further includes dimming circuitry components for controlling the brightness of the LED module.

In an embodiment, the first PCB includes a metal PCB (MCPCB). According to an aspect, the metal PCB includes aluminum. Aluminum PCBs, or PCBs made from other metals with a high heat transfer coefficient, transfer heat away from the LED and into the heat sink most efficiently.

In an embodiment, a thermally conductive interface is provided between the first PCB and the heat sink. Suitable thermally conductive interfaces are, by way of example, thermally conductive grease, thermally conducting pads, graphite foil, or thermally conductive acrylic film.

According to an aspect, the second PCB includes a glass-reinforced epoxy laminate sheet, such as FR-4.

In a further embodiment the second PCB further includes a metal PCB. This arrangement is particularly effective when the control circuitry includes an Integrated Circuit (IC) that produces a significant amount of heat that warrants it being mounted on a separate metal PCB (MCPCB), attached in some way to the second PCB to form a second PCB assembly. Separating the main heat producing components on the second PCB onto a separate metal core PCB brings significant advantages in controlling the heat produced during prolonged operation. In an embodiment, this metal PCB includes aluminum.

According to an aspect, the heat sink includes a body formed from material including a thermally conductive material. In this way, the lamp body of the LED lighting module may also be a heat sink, which may be formed from or may include aluminum.

In an embodiment, the lamp body takes the form of a substantially hollow substantially frustoconical shape, closed at or near its narrower end by a rear wall having a front face and a rear face. This may include the shape of a conventional GU10 lamp body.

According to an aspect, the front face of the rear wall is substantially planar. This is the region where the LED PCB is in close thermal contact with the rear wall of the heat sink body once assembled and keeping this region planar improves heat transfer.

In an embodiment, the heat sink body incorporates a plurality of fins to aid convection of heat away from the heat sink and preferably some or all of the fins are located inside the body.

According to an aspect, the thermal insulation material includes a disc of plastics material that sits against the rear face of the rear wall of the heat sink body.

The LED lighting module may include a lamp cap fitting. According to an aspect, the lamp cap fitting is a GU10 is a fitting. This may enable the second printed circuit board to be accommodated within the GU10 cap fitting.

In an embodiment, the thermal insulation material includes a potting compound which surrounds the second PCB, or second combination of PCBs to encapsulate it and thermally isolate it from both the heat sink and the first PCB.

According to an aspect, the lighting module further comprises a lens, a lens holder, and a lens cover.

The present disclosure extends to include light fittings incorporating an LED lighting module as described.

BRIEF DESCRIPTION OF THE DRAWINGS

These and other objects and advantages will become apparent upon reading the detailed description and upon referring to specific embodiments thereof that are illustrated in the appended drawings. Understanding that these drawings depict only typical embodiments thereof and are not therefore to be considered to be limiting of its scope, embodiments will now be described, by way of example only, in relation to the accompanying figures in which.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

DETAILED DESCRIPTION

Reference will now be made in detail to various embodiments. Each example is provided by way of explanation, and is not meant as a limitation and does not constitute a definition of all possible embodiments.

In the context of the present disclosure, the term 'LED lighting module' refers to a functioning LED light engine and it associated control circuitry, such as a power supply, dimmer, and/or control IC or electronics. The term 'LED module' refers to one or more LED light engines mounted on a suitable PCB, with or without any associated control circuitry.

Figures 1A, 1B:
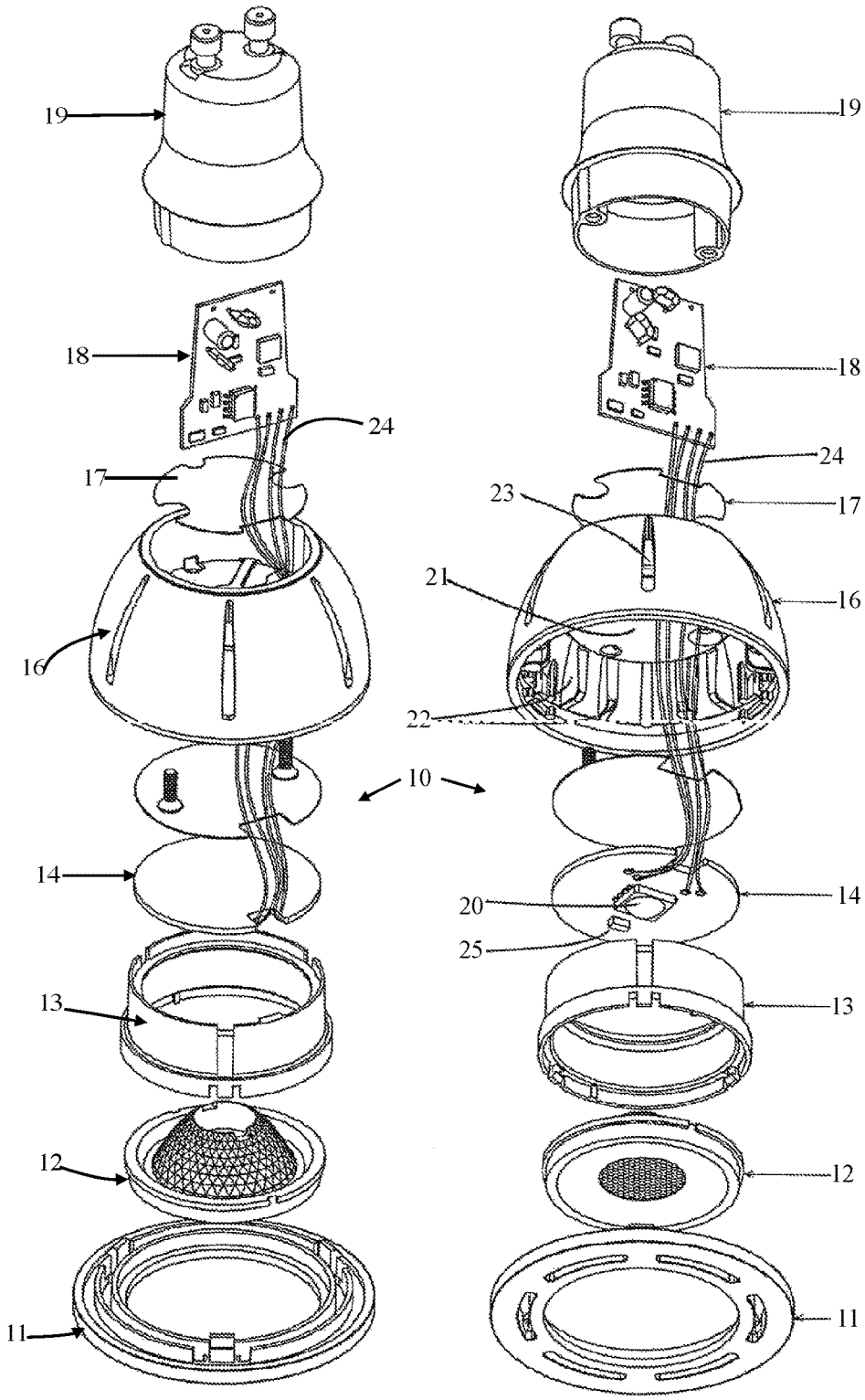
FIGS. 1A and 1B illustrate exploded views of a non-dimmable lighting module with the control components on a single second PCB, according to an embodiment.
Figure 2:
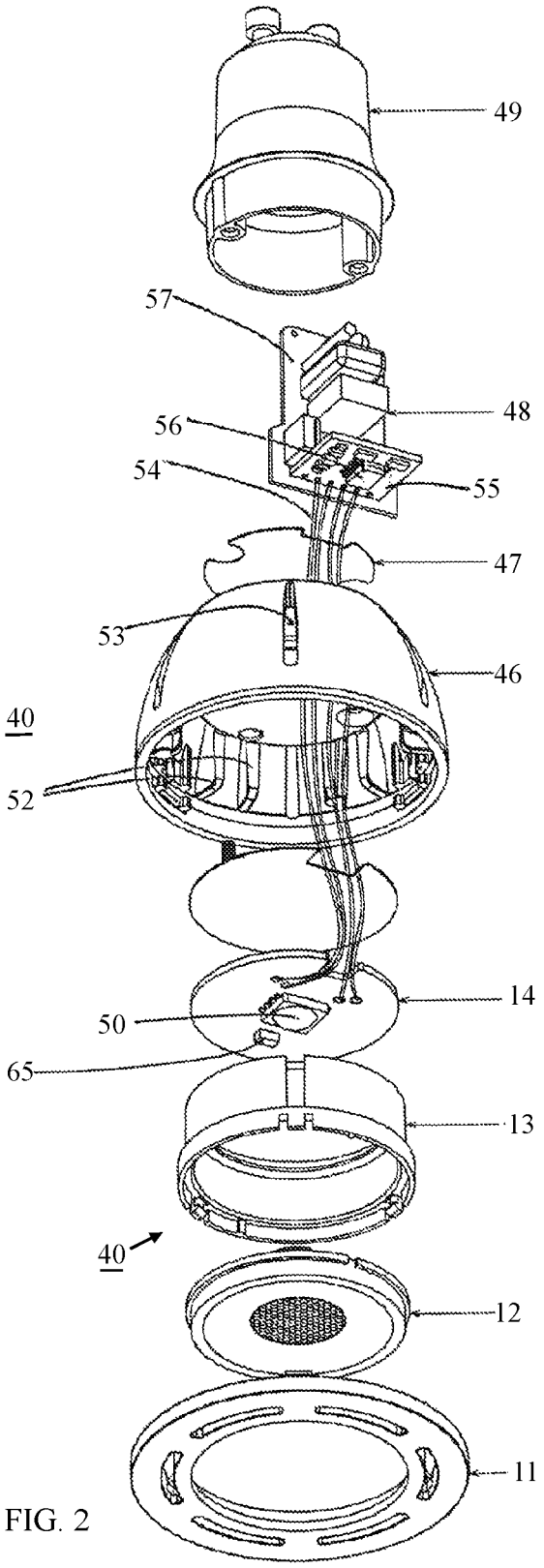
FIG. 2 illustrates an exploded view of a dimmable LED lighting module with the dimming and control components on a second PCB incorporating a supplementary PCB, according to an embodiment.
Figure 3A:
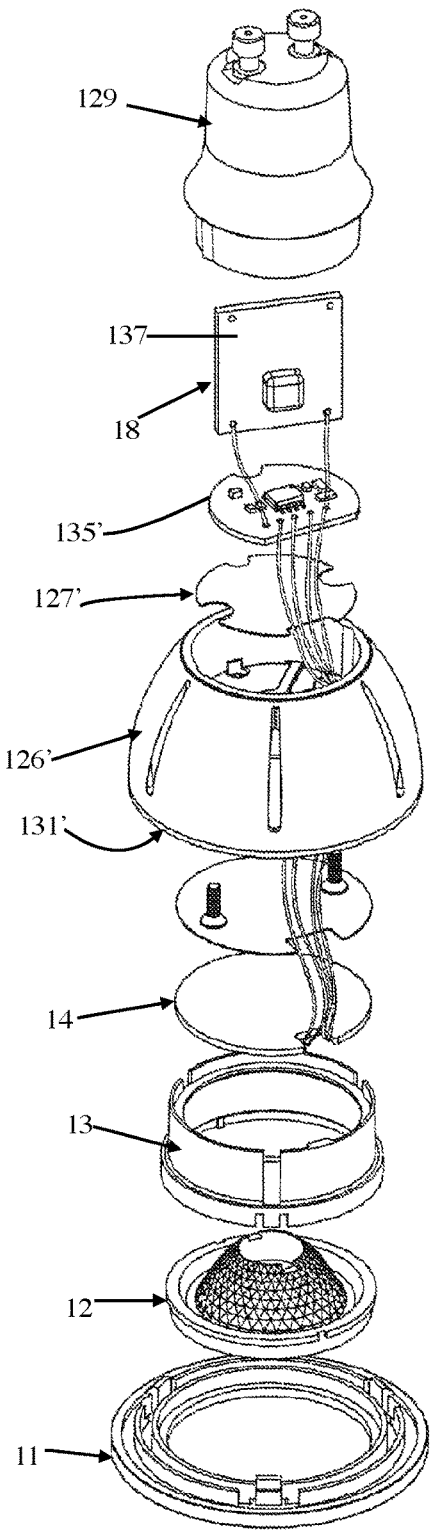
FIGS. 3A and 3B illustrate exploded views of a non-dimmable LED lighting module in which the control components are distributed between two PCBs inside a GU10 cap, according to an embodiment.
Figure 3B:
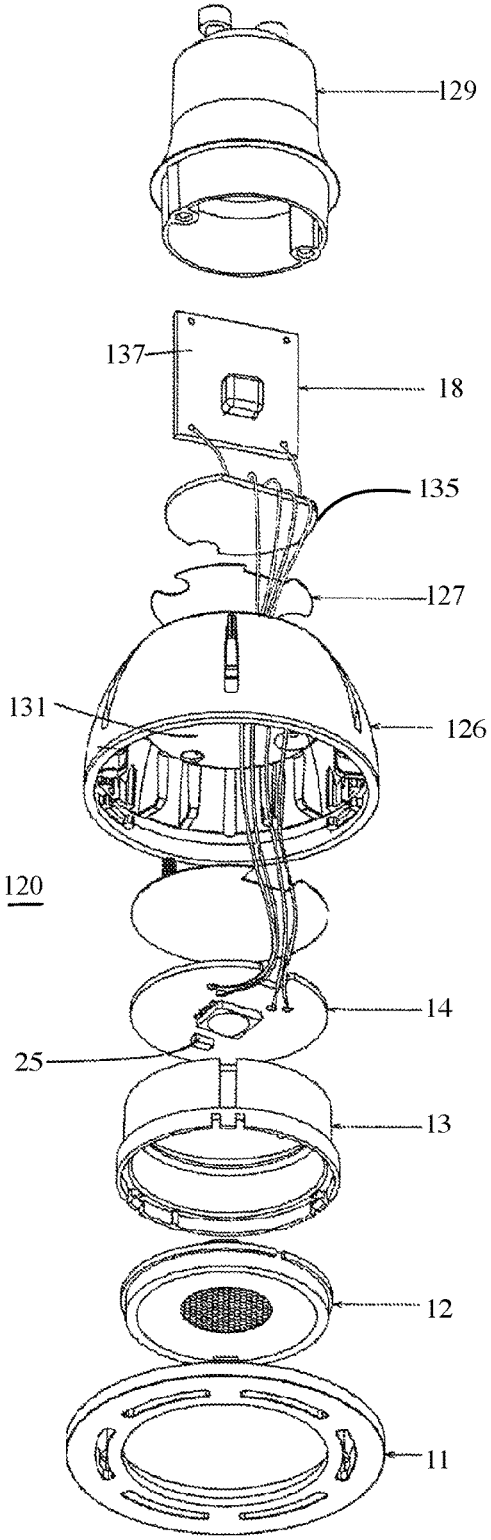
Figure 4A:
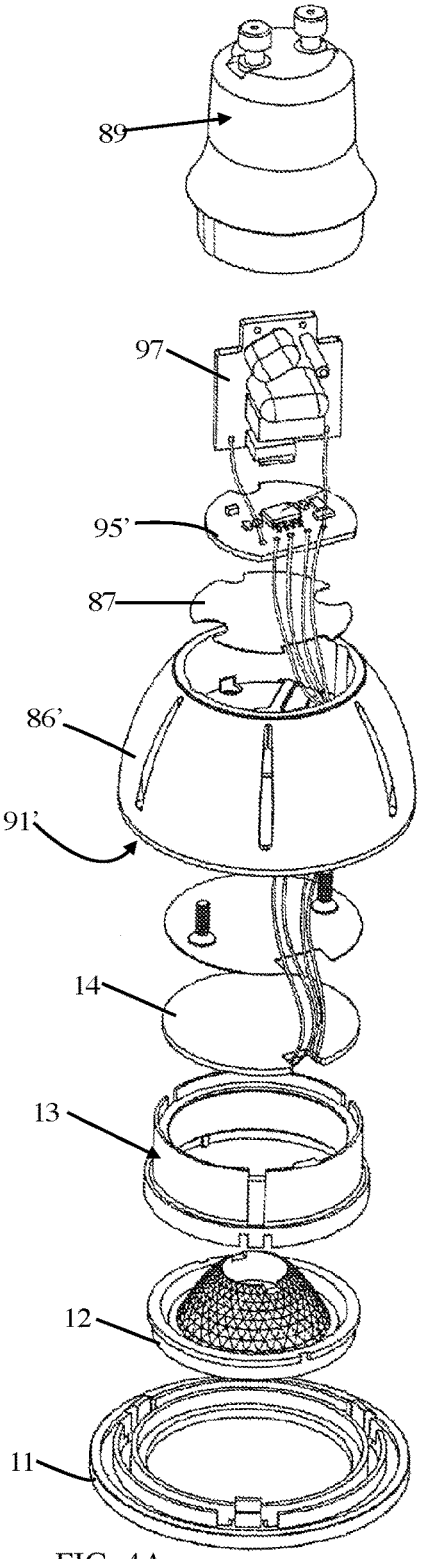
FIGS. 4A and 4B illustrate exploded views of a dimmable version of the LED lighting module shown in FIGS. 3A and 3B.
Figure 4B:
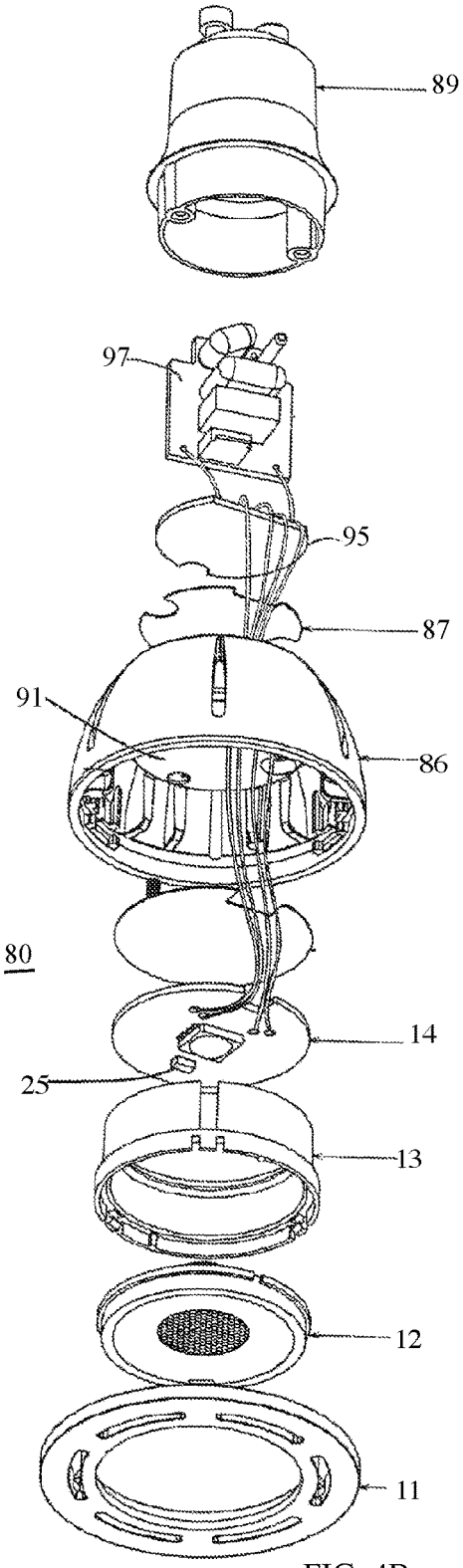

Referring to FIGS. 1A and 1B, these illustrate exploded diagram views of an LED lighting module according to an embodiment. According to an aspect, a GU10 lamp 10 is provided. (A similar lamp 40 is seen in FIG. 2, 120 in FIGS. 3A and 3B, 80 in FIGS. 4A and 4B). The lamp 10 may include a GU10 cap 19, an aluminum lamp body 16 which acts also as a heat sink, a lens holder 13, a lens 12 and a cover 11. These components may be similar to other components found in an existing GU10 lamp. The arrangement and positioning of the LED module and the associated power management and power conversion, driver, dimming, control and sensing components within the LED lighting module is distinguishable/different from known lighting modules. More specifically, an LED board 14 may be provided on which is mounted an LED 20. (A similar LED 50 is seen in FIG. 2). Other electronic components are mounted elsewhere, away from the LED PCB, with the possible exception of a diode 25 to protect the LED from reverse breakdown voltage. (A similar diode 65 is seen in FIG. 2). The LED PCB and thus the LED 20 may also be in good thermal contact with the inner side of the rear end wall 21 of the aluminum body. This good thermal contact may be enhanced by means of thermally conductive interface materials such as thermally conductive grease, a thermally conducting pad or pads, graphite foil, thermally conductive acrylic film, or thermally conductive nano composites or polymers. It will be understood by a person of ordinary skill in the art that any suitable thermally conductive material can be used for this purpose. According to an aspect, the front face of the rear end wall 21 of the body 16 is substantially planar to facilitate heat transfer over the whole surface area of the back of the LED PCB 14.

In terms of electrical/electronic components generating a heat load, the LED 20 may be the only such component mounted on the LED PCB 14, and thus only heat generated by the LED is transmitted to, and dissipated by, the aluminum lamp body 16. According to an aspect, a plurality of internally directed heat fins 22 is incorporated in the body 16 to aid in the heat dissipation process. (Similar heat fins 52 are seen in FIG. 2).

In an embodiment, a plurality of apertures 23 or slits 23 is also provided in the aluminum body designed to aid air circulation and thus heat dissipation. (Similar slits 53 are seen in FIG. 2).

It will be appreciated that, while it is advantageous to have a plurality of fins or slits to help dissipate heat, one large fin and/or slit could suffice.

The other electrical/electronic components required for operation of the LED lighting module may be located on a separate, second PCB 18, which may be sized and shaped to fit within the GU10 cap 19. These components include, but are not limited to, driver components, power management and power conversion components, and control components. Where a dimming function is provided, the dimming components may also be incorporated into this PCB/board, or on a further separate PCB within the GU10 cap (see FIGS. 2 and 4 and associated description below).

In an embodiment, the second PCB 18 is made from a glass-reinforced epoxy laminate sheet, such as FR-4, and is encapsulated within the GU10 cap 19 with a potting compound, further isolating the heat produced by the components on the second PCB from the heat sink and thus from the LED itself. To improve this thermal isolation, a layer of insulating material 17 may optionally be placed over the outer side of the rear end wall 21 of the aluminum body, being the side facing towards the GU10 cap 19. Any suitable insulation material may be used for this purpose. In an embodiment, a sheet of plastics material is used as the insulation material, thus providing a cost effective solution.

Although the lamp body 16 has been described as being made of aluminum, any thermally conductive material could be used. The thermally conductive material may be a metal or a non-metal. According to an aspect, aluminum is used and provides high thermal conductivity, reasonable cost, and ease of moulding or working. The first MC PCP 14 and the second IC Board PCB 18 may be connected by wires 24 in a conventional manner. In an embodiment, four wires are provided because the LED and driver are of a three-stage design, with 3 negative poles and 1 positive pole. It will be appreciated that in the arrangement described, only heat generated by the LED has to be dissipated by the heat sink. As a result, the LED may be driven harder in order to increase its light output, or extend the LED service life, or both.

In an embodiment and as illustrated in FIG. 2 the GU10 lamp, is dimmable. A similar numbering system to that used in FIG. 1 has been adopted for FIG. 2. According to an aspect, the control circuitry and the additional circuitry required for the dimming function are contained on a composite PCB 48 housed within the GU10 cap 49. The IC board 48 may include two parts, such as, a glass-reinforced epoxy laminate board 57 (e.g. a PCB made from FR-4) and a MCPCB 55 mounted substantially at right angles to the PCB 57. The MCPCB 55 may carry the main control IC 56, which has a greater heat output when it includes a dimming function, and thus may be mounted on a MCPCB. These two boards may be connected by way of soldered connections 54 or more preferably by a plug-in arrangement. According to an aspect, the dual IC board 48 is fully potted within the GU10 cap and a layer of insulating material 47 provides further thermal separation from the heat sink body 46.

The arrangement of PCBs shown in FIG. 2 where board 55 is substantially perpendicular to board 57 is only one of many possible arrangements. For example, the smaller board 55 may be positioned over board 57 in a sandwich type arrangement.

FIGS. 3A, 3B, 4A and 4B illustrate further embodiments of arrangements of the electrical/electronic components other than the LED itself. According to an aspect, the components can be housed away from and thermally isolated from the LED PCB, and within the GU10 cap. In each of FIGS. 3A, 3B, 4A and 4B a similar numbering system to the numbering system used in FIG. 1 has been adopted. In an embodiment, the components may be split/separated between two separate PCBs. According to an aspect, one of the two IC PCBs 95, 135 is substantially circular and sits on a layer of insulating material 87, 127 on the rear face of the rear wall of the body 91, 131. This PCB may be connected by four wires to the LED PCB. A further PCB 97, 137 may be located/arranged up inside the GU10 cap 89, 129 and connected to the PCBs 95, 135 respectively by wire connections. These PCB's can be formed from any suitable material, or combination of materials such as FR-4 or a MCPCB as dictated by the respective component heat outputs. According to an aspect, the PCB combinations are fully potted inside the respective GU10 caps. This may be most easily achieved by injecting the potting compound through the GU10 cap once the module is assembled.

The embodiments shown in FIG. 3 and FIG. 4 lend themselves to an alternative form of construction. In this alternative form, not shown, the lower PCB 95', 135' may be a MCPCB and the layer of material between the MCPCB and the module body 86', 126' may be a thermally conductive interface layer rather than a thermal insulator 87', 127'. According to an aspect, the outer surface of the rear end wall 91', 131' of the module body is substantially flat and planar, which may encourage good heat transfer into the heat sink. In this way, heat generated by the components on PCB's 95', 135' can be dissipated by the heat sink.

Embodiments of the present disclosure are applicable to the latest type of 'smart' LED lamps and luminaires that contain detectors that sense information about their local environment and which communicate this information to a processor. These luminaires may offer a way of collecting data about the environment in which they are situated. This may overcome the problems associated with dedicated sensors in a particular location, such as a thermostat which only covers a limited area, because a building or house will typically contain many luminaires, each potentially capable of gathering data. The data gathered by 'smart' luminaires thus has a much higher granularity than data collected by other approaches, and is therefore more useful. However this brings with it the need for much greater data gathering/storing and data processing capability in 'smart' luminaires than in conventional LED lamps, as well as the need to pass on this data by wireless or by power-line communication (PLC). This can have a significant impact on the amount of heat produced by the onboard control IC chip(s) or other electronic circuitry. Embodiments of the present disclosure allows this additional heat output to be dealt with effectively, without compromising the life of the LED light engine(s) and without the need for larger heat sinks.

Figure 5:
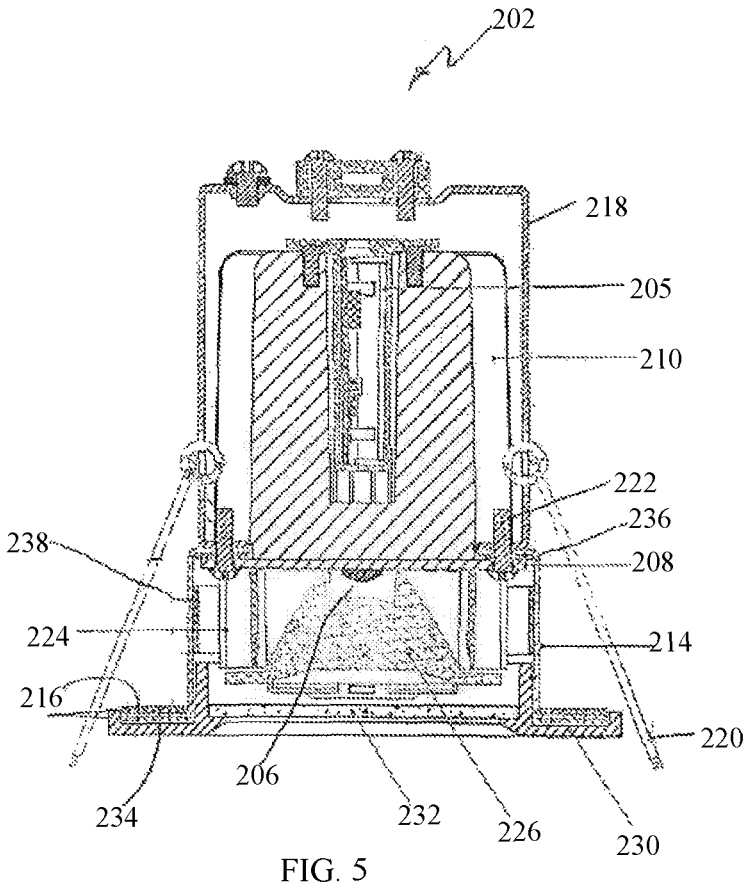
FIG. 5 shows a sectional view of a downlight design in accordance with an embodiment.
Figure 6:
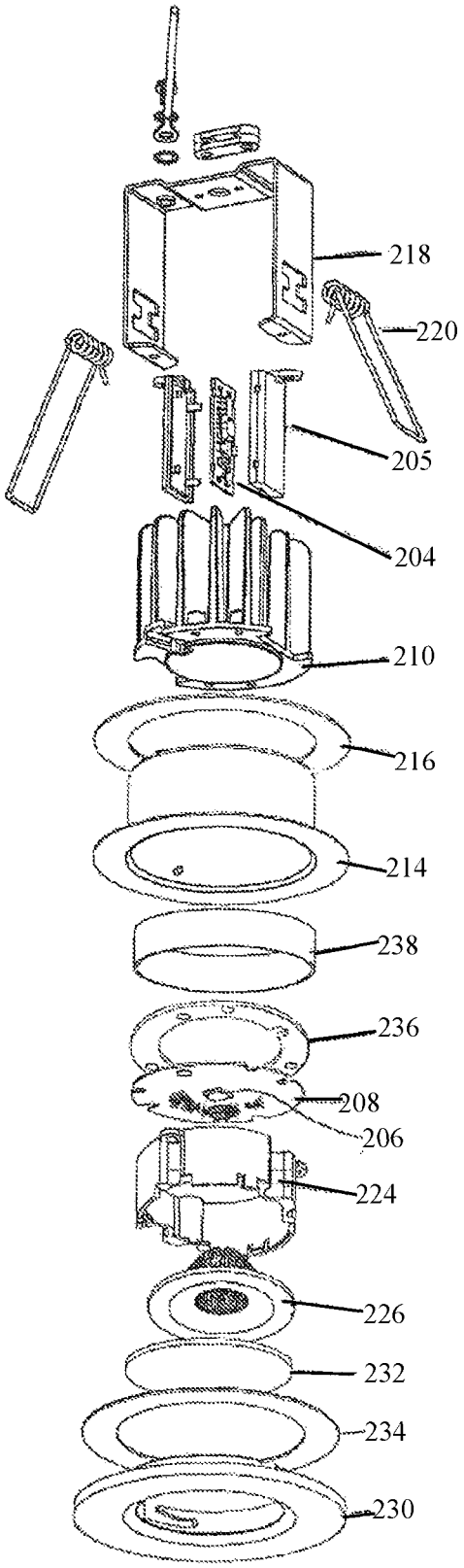
FIG. 6 shows an exploded component view of the downlight design of FIG. 5.

Whilst the embodiments described herein includes the GU10-type lamps, this disclosure contemplates any type of lamp or luminaire in which there is space behind or away from the LED PCB to accommodate a second PCB or second PCB assembly. In an embodiment, and as illustrated in FIGS. 5 and 6, the LED module is incorporated into a fire rated downlight assembly, fixture or unit 202. The downlight unit 202 may include a light source 206 in the form of an LED light engine mounted to a printed circuit board 208, thus forming an LED module. In an embodiment, the circuit board is of a material having a relatively low melting point (in comparison to the fire rating test temperature), such as, for example, an aluminum or coated aluminum circuit board. The melting point of the aluminum is around 660 degrees C., which is well below the temperature at which fire rating tests are performed.

Within the context of the present disclosure, the reference to a melting point is a reference to the temperature at which the structural integrity of the circuit board can no longer be maintained. In the case of a metal circuit board, this is the melting point, but in the case of a ceramic circuit board, the meaning will readily be apparent to one of ordinary skill in the art.

According to an aspect, the downlight unit further includes a heat sink 210 provided to a rear side of the circuit board 208, in good thermal contact with it, and a lens arrangement located at a front side of the circuit board.

The circuit board 208 and the heat sink 210 may be physically, though not thermally, connected by way of a cylindrical casing or mounting ring 214 as described hereinbelow. The circuit board 208 may be manufactured to have good thermal conductivity properties, for example from a material inherently having such properties or treated to have such properties. This may allow for heat generated by the LED Light engine to pass efficiently to the heat sink.

The term "cylindrical casing" means conforming approximately to the shape of a hollow cylinder. It will be understood that a misshapen cylinder will work equally well. Similarly, while the embodiments may show a generally circular cylindrical tubular body other sections may be used with amendment/modification to the sectional shape of other components.

According to an aspect, the heat sink 210 is formed from any suitable material, such as cast or extruded aluminum. The heat sink 210 may include, at a lower end, an outer annular portion that may be located against an upper portion of the cylindrical casing. In an embodiment, the annular portion surrounds an end face of the heat sink.

The cylindrical casing or mounting ring 214 may include a side wall having a lower peripheral annular flange extending outwardly from a bottom end of the side wall to form a front face and an upper peripheral annular flange extending inwardly from an upper end of the side wall to form a rear face having an opening. The mounting ring 214 may be formed from any suitable material, such as, for example, steel. It will be understood that the melting point of steel is typically above the temperature used for fire rating tests and a suitable steel may be chosen with this in mind.

In an embodiment, the upper peripheral flange is located against the annular portion of the heat sink 210 and surrounds the end face of the heat sink. According to an aspect, this enables the heat sink to close the mounting ring from the rear.

According to an aspect, a bracket 218 having depending legs and a central portion is provided in which spring biased members or clips 220 are mounted on each of the legs. Feet at the free ends of the legs are secured to the mounting ring 214.

Other electrical/electronic components may be required for operation of the LED lighting module, such as a driver 204, and other control circuitry components may be mounted on a second PCB or PCB assembly within a so-called driver box 205, in turn located within a void or recess in the heat sink 210. In an embodiment, the driver box 205 is provided with flanges by which the driver box 205 may be secured to an upper part of the heat sink 210 or the bracket 218 by any suitable means, whilst maintaining good thermal insulation between the second PCB and the heat sink. It will be appreciated that this is not the only possible location for the driver box, which could be located away from the heat sink in another suitable location, such as mounted on the bracket 218.

The heat sink 210 may be mounted on the mounting ring 214 with a front face of the heat sink 210 extending through the upper annular flange of the mounting ring 214 to close the opening at the rear of the mounting ring 214.

A first ring or washer 216 of silicone may be provided on the lower peripheral flange of the mounting ring 214. In an embodiment, the ring or washer 216 of silicone provides a relatively airtight seal between the lower peripheral flange of the mounting ring 214 and a rim of a ceiling aperture into which the downlight fixture is fitted. This seal may also serve to prevent water or other moisture, such as steam, from passing from a room into the space behind the ceiling.

In an embodiment the circuit board 208 is secured to the heat sink 210 by fasteners 222 extending through the mounting ring 214, such that the end face of the heat sink 210 is held in thermal contact with a substantial part of the rear surface of the circuit board 208. A periphery of the rear surface of the circuit board may extend radially beyond the heat sink.

The fasteners 222 may also serve to secure a lens holder in position. A lens holder 224 is used to locate a lens 226 in position.

According to an aspect, the lens holder 224 is secured in place to seat against the circuit board 208.

A glass 232, retained by a bezel 230, may be located within and by the mounting ring 214. According to an aspect, the glass 232 is disposed in front of the lens 226 and lens holder 224. A second ring or washer 234 of silicone may extend between the bezel 230 and the mounting ring 214. The space within the mounting ring 214 above the glass 232 may define a void within which the lens 226 is located by the lens holder 224.

In an embodiment, the fasteners 222 extend through a ring or washer 236 of fireproof material or other non-thermally conductive material conveniently located between the periphery of the circuit board 208 and upper annular flange of the mounting ring 214. In this way, the printed circuit board may be kept separated from the mounting ring 214 in such a way that it is not in direct contact with the mounting ring 214.

According to an aspect, the fireproof material of the ring or washer 236 takes the form of a ring of intumescent material.

A collar or sleeve of 238 of intumescent fireproof material may be located around an upper portion of the side wall of the mounting ring 214. In an embodiment, the fireproof material takes the form of a continuous sleeve of intumescent material. A discontinuous sleeve of intumescent material may be used instead.

The sleeve may be of sufficient dimension that upon expansion due to heat, the intumescent fireproof material expands to form a fireproof barrier. It will be understood that any suitable arrangement whether a continuous sleeve or a discontinuous sleeve can be selected to achieve the desired fire rating.

In an embodiment, the sleeve 238 may cover around half of the internal surface of the tubular body of the mounting ring 214. An upper edge may be located below the ends of the fasteners depending into the void. A lower edge of the sleeve 238 may be located above the bezel 230, such as where the bezel 230 extends, in use, into the tubular body of the mounting ring.

In an embodiment, during normal use, the heat generated by the solid state lighting unit is taken from the circuit board and dissipated via the heat sink 210. In this way the heat within the void is not sufficient to trigger expansion of the fireproof intumescent material.

According to an aspect, in the event of a fire the greater temperatures to which the fireproof material is then subjected to, will cause the fireproof material to expand and fill the void with a barrier having fire resistant properties. This in turn may protect the circuit board from damage by such temperatures, thus allowing the structural integrity of the downlight assembly to be maintained for the duration of the fire rating test.

In an embodiment, the combination of a low melting point circuit board, which allows for efficient direct conduction of heat from the lighting unit to the heat sink, as well as thermally isolating the second control PBC from the heat sink, together with the sleeve of intumescent fireproof material which is only triggered on exposure to higher levels of heat than are normally present, enables the production of an improved fire rated downlight fixture utilising solid state technology with much improved service life. The space within the void inside the heat sink 210 may be more than sufficient to accommodate all the power, control, dimming, communication and processing circuitry and components necessary for the operation of a 'smart' luminaire.

The components of the apparatus illustrated are not limited to the specific embodiments described herein, but rather, features illustrated or described as part of one embodiment can be used on or in conjunction with other embodiments to yield yet a further embodiment. It is intended that the apparatus include such modifications and variations. Further, steps described in the method may be utilized independently and separately from other steps described herein.

While the apparatus and method have been described with reference to specific embodiments, it will be understood by those skilled in the art that various changes may be made and equivalents may be substituted for elements thereof without departing from the scope contemplated. In addition, many modifications may be made to adapt a particular situation or material to the teachings found herein without departing from the essential scope thereof.

In this specification and the claims that follow, reference will be made to a number of terms that have the following meanings. The singular forms "a," "an" and "the" include plural referents unless the context clearly dictates otherwise. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. An LED downlight lighting module comprising:

an LED module comprising one or more single LED(s) on a first printed circuit board;

a heat sink, wherein the first printed circuit board is in thermal contact with the heat sink such that heat from the LED(s) on the LED module is dissipated through the heat sink; and a second printed circuit board adapted to accommodate a power and control circuitry for the LED(s), wherein the second printed circuit board is located within a driver box accommodated within one of a void and a recess in the heat sink structure, and wherein the driver box is thermally insulated from both the heat sink and from the first printed circuit board, and thus from the LED(s), wherein the first printed circuit board and the second printed circuit board are disposed on opposite sides of the heat sink and are thermally insulated from one another, and wherein the heat sink takes the form of a substantially frustoconical shape closed at or near its narrower end by a rear wall having a front face and a rear face.

2. The LED downlight lighting module of claim 1, wherein the second printed circuit board further comprises a dimming circuitry for the LED(s).

3. The LED downlight lighting module of claim 1, wherein at least one of the first printed circuit board and the second printed circuit board comprises a metal printed circuit board.

4. The LED downlight lighting module of claim 3, wherein the metal printed circuit board comprises aluminum.

5. The LED downlight lighting module of claim 1, further comprising a thermally conductive interface between the first printed circuit board and the heat sink.

6. The LED downlight lighting module of claim 5, wherein the thermally conductive interface comprises one of a thermally conductive grease and a thermally conducting pad.

7. The LED downlight lighting module of claim 1, wherein the second printed circuit board comprises a glass-reinforced epoxy laminate sheet.

8. The LED downlight lighting module of claim 1, wherein the heat sink comprises a plurality of fins.

9. The LED downlight lighting module of claim 1, further comprising a lens.

10. The LED downlight lighting module of claim 9, further comprising a lens cover.

11. An LED downlight lighting module comprising:

an LED module comprising one or more single LED(s) on a first printed circuit board;

a heat sink, wherein the first printed circuit board is in thermal contact with the heat sink such that heat from the LED(s) on the LED module is dissipated through the heat sink; and a second printed circuit board adapted to accommodate a power and control circuitry for the LED(s), wherein the second printed circuit board is thermally insulated from both the heat sink and from the first printed circuit board, and thus from the LED(s), wherein the first printed circuit board and the second printed circuit board are disposed on opposite sides of the heat sink and are thermally insulated from one another, and wherein the heat sink takes the form of a substantially frustoconical shape closed at or near its narrower end by a rear wall having a front face and a rear face.

12. The LED downlight lighting module of claim 11, wherein the second printed circuit board further comprises a dimming circuitry for the LED(s).

13. The LED downlight lighting module of claim 11, wherein at least one of the first printed circuit board and the second printed circuit board comprises a metal printed circuit board.

14. The LED downlight lighting module of claim 11, wherein the second printed circuit board comprises a glass-reinforced epoxy laminate sheet.

15. The LED downlight lighting module of claim 11, wherein the heat sink comprises a plurality of fins.

16. The LED downlight lighting module of claim 11, further comprising a lens.

17. The LED downlight lighting module of claim 16, further comprising a lens cover.

18. The LED downlight lighting module of claim 11, further comprising a thermally conductive interface between the first printed circuit board and the heat sink, wherein the thermally conductive interface comprises one of a thermally conductive grease and a thermally conducting pad.

* * * * *